United States Patent [19]

Barron

[11] 4,044,412

[45] Aug. 30, 1977

[54] TUFTING BUTTON

[75] Inventor: James Elliott Barron, Midland, Tex.

[73] Assignee: Magnatex Corporation, Midland, Tex.

[21] Appl. No.: 702,370

[22] Filed: July 2, 1976

[51] Int. Cl.[2] ..... A47C 27/00; A44B 1/18; A44B 17/00

[52] U.S. Cl. ..... 5/356; 24/90 B; 24/208 A

[58] Field of Search ..... 5/356; 24/90 B, 141, 24/142, 208 A

[56] References Cited

U.S. PATENT DOCUMENTS

| | | | |
|---|---|---|---|
| 1,823,700 | 9/1931 | Pittoni | 24/90 B |
| 1,932,207 | 10/1933 | Droll et al. | 24/90 B |
| 2,016,157 | 10/1935 | Rosenberger | 5/356 |
| 3,328,854 | 7/1967 | Tombari | 24/141 |
| 3,701,174 | 10/1972 | Randolph | 5/356 |

*Primary Examiner*—Paul R. Gilliam
*Assistant Examiner*—A. M. Calvert
*Attorney, Agent, or Firm*—John J. Byrne; Edward E. Dyson

[57] ABSTRACT

A tufting button comprising an upper and lower portion in axial interconnection by means of an interconnection means having a hole axially disposed therein for use in combination with a cushion or the like.

3 Claims, 5 Drawing Figures

TUFTING BUTTON

This invention relates to a tufting button. More specifically, this invention relates to a novel tufting button in combination with a cushion or the like.

A button is tufted to cushions in furniture for functional purposes as well as aesthetic value. When used outdoors or in partially enclosed patios, a special problem is encountered with tufted furniture. It is common knowledge that stagnant water is damaging to cushions as the water will absorb or impregnate the interior causing mildew, rot, fungus, and the like. This vulnerability to rot and mildew is especially true of older cushions whose exteriors have degraded through exposure to outside elements such as the sun or salt water. This is especially true for furniture such as patio furniture, cushions for marine vehicles, stadium cushions, or the like. Therefore, it is highly advantageous to alleviate the standing or residence of water upon the cushion. This is true in cushions for marine vehicles because the water contact is almost constant. The chance of mildew is also augmented by humid climates. It has been found that a cushion with a unique tufted button therein will alleviate the water-standing problem. This is a result of an opening axially located in the tufting button to permit gravitational drainage of the water. Also, many marine cushions double as life preservers. Tufted buttons of the type described will not affect the life-preserving qualities of the cushions.

One aspect of this invention resides in a button which comprises an upper and lower portion of substantially equal circumference with interconnection by means of an axial connection having a hole centrally disposed therein.

Another aspect of this invention will reside in combination with a cushion having a top planar surface and a lower planar surface, a tufting button comprising an upper portion in interconnection with a lower portion and an interconnection means, said upper portion disposed in a substantially parallel plane with said top planar surface, said lower portion disposed in a substantially parallel plane with said lower planar surface and wherein a hole is axially disposed within said connection means to permit free gravitational passage of water from said top planar surface to said lower planar surface.

A specific embodiment of this invention resides in a marine cushion having a tufted button therein possessing a centrally disposed axial hole for drainage.

Yet another specific embodiment of this invention resides in a metallic tufting button having a centrally disposed axial drainage hole.

Still another embodiment of this invention resides in a tufted drainage button having a top metallic potion (usually aluminum) and a lower plastic portion.

SUMMARY OF THE INVENTION

As hereinbefore set forth, this invention relates to a novel tufted button. This invention also relates to a tufted button in combination with a cushion utilized on a marine vessel.

The tufting button is comprised of an upper portion, an interconnection means and a lower portion. The interconnection means has an opening centrally disposed therein to permit gravitational drainage of water. The hole is outlined by the inner wall of the interconnection means; the circumference of the void area being substantially equal to the inner wall cicumference. The actual dimensions of the opening will vary with the diameter of the top and lower portions of the tufting button, the only criticality being that the diameter of the hole is not so great in relation to the side walls of the interconnection means to render the same vulnerable to breakage as a result of the thinness thereof. The actual dimensions of the opening in the hole can be easily derived by one skilled in the art of material strengths. The material of the button may be selected from synthetic plastic, metal (aluminum or a related alloy, steel, stainless steel, or the like), natural wood or synthetic wood. The top portion is snapped or locked into the bottom portion by a connection means, the male portion of which is disposed at the lower end of the interconnection means and the female portion of which is disposed in the upper end of the lower portion. The button is tufted to the cushion by conventional means, the actual exterior and interior cushion material also being any conventional material such as vinyl-covered foam rubber.

These and oher objects of the invention will become more apparent to those skilled in the art by reference to the following detailed description when viewed in light of the accompanying drawings wherein.

Figure 1:
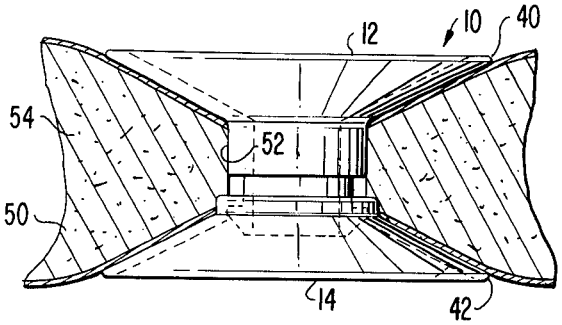
FIG. 1 is a side view of a tufting button.
Figure 2:
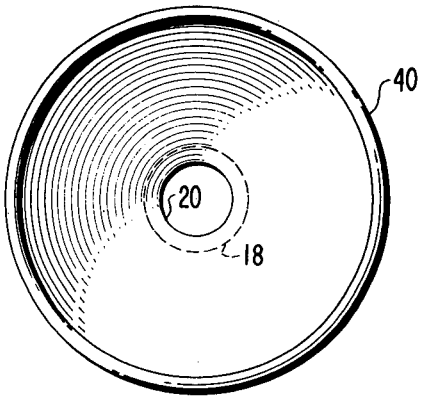
FIG. 2 is a top view of the tufting button of FIG. 1.
Figure 3:
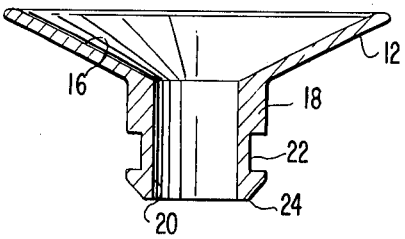
FIG. 3 is a cross-sectional view of the top portion of the tufting button.
Figure 4:
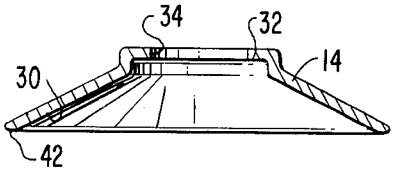
FIG. 4 is a cross-sectional view of the bottom portion of a tufting button.

Referring now to the drawings wherein like numerals indicate like parts, the numeral 10 indicates the tufting button of this invention. The tufting button is comprised of two principal elements, a top portion indicated by the numeral 12 and a bottom portion indicated by the numeral 14. The top portion 12 has an upper outwardly flared portion 16 having a depending, cylindrical portion 18 having an inner opening 20. On its exterior surface, the cylinder 18 is formed with a cylindrical groove 22. The lower portion of cylinder 12 below groove 22 is tapered toward the opening 20 as indicated by the numeral 24.

The lower half of the tufting button 14 is formed of an outwardly flaring skirt 30 having an inwardly directed top flange 32 defining an opening 34. The flange 32 has a thickness less than the height of the groove 22 of the stem or cylindrical portion 18. The upper edges of the member 12 and skirt 14 are formed with a circular, rounded ridge as shown by the numerals 40 and 42, respectively.

Figure 5:
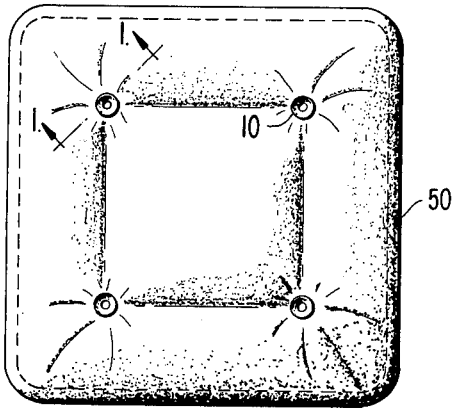
FIG. 5 is a top view of a marine cushion with tufted buttons (4) residing therein.

As seen best in FIG. 1, the member 14 is snapped into position such that the flap 32 is received by the circular groove 22. In FIG. 5, there is shown a nautical cushion with four of the tufting buttons utilized therein. As seen in the FIG. 1, the tufting button is adapted to be received in preformed holes of a tufted member such as the pillow 50. Pillow 50 is equipped with pre-formed apertures 52. The tufting buttons are inserted by placing the button member 14 against the lower surface of the pillow 50. The upper portion 12 is inserted through opening 52 and snapped into groove 22. The tapered surface 24 aids in the penetration of the stem 18 into opening 34. The groove 20 has a greater width than the width of the flange 32. This automatically permits a certain width adjustment, depending on the tightness and resiliency of the stuffing material 54. Cushion 50 is usually about 5 inches in thickness. The principal elements are not required to be of the same material. In one commercial embodiment, upper member 12 is made of aluminum and the lower portion 14 is made of plastic.

In a general manner, while there has been disclosed an effective and efficient embodiment of the invention, it should be well understood that the invention is not limited to such an embodiment, as there might be changes made in the arrangement, disposition, and form of the parts without departing from the principle of the present invention as comprehended within the scope of the accompanying claims.

I claim:

1. A tufting button for a cushion having an upper substantially planar surface, a lower substantially planar surface and a tufting material disposed therebetween, the tufting button comprising:

a first enlarged flanged portion having a central aperture therein and conically configured sides sloping toward the central aperture;

a first cylindrical portion connected to said enlarged flange portion and havig a central longitudinal axis in alignment with the center of the aperture in said first enlarged flange portion;

a second enlarged flange potion having a central aperture therein and conically configured sides sloping toward the central aperture;

a second cylindrical portion connected to said second enlarged flange portion and having a central longitudinal axis in alignment with the center of the aperture in said second enlarged flange portion;

first means connected to said first cylinder portion for engaging and interconnecting said first cylinder portion with said second cylinder portion; and second means connected to said second cylinder portion for cooperatively engaging and interconnecting with said first means for connecting said second cylinder portion with said first cylinder portion, wherein fluid contacting either of said first or second enlarged flange portions will be funneled into and axially through said first and second cylindrical portions of the tufting button without contaminating the tufting material of a cushion tufted with the tufting button.

2. A tufting button as defined in claim 1 wherein:

said first enlarged flange portion and said first cylindrical portion are fabricated from a plastic material; and said second enlarged flange portion and said second cylindrical portion are fabricated from a metallic material.

3. A tufting button as defined in claim 1 wherein:

said first means comprises a trapezoidal male flange peripherally extending about the outer surface of said first cylindrical portion; and said second means comprises a female member for receiving said male member.

* * * * *